US007124909B1

(12) United States Patent
Armato

(10) Patent No.: US 7,124,909 B1
(45) Date of Patent: Oct. 24, 2006

(54) HINGED LID CONTAINER

(75) Inventor: Keith Armato, Winnetka, IL (US)

(73) Assignee: V V G I Corporation, Chicago, IL (US)

( * ) Notice: Subject to any disclaimer, the term of this patent is extended or adjusted under 35 U.S.C. 154(b) by 178 days.

(21) Appl. No.: 10/755,110

(22) Filed: Jan. 9, 2004

Related U.S. Application Data

(60) Provisional application No. 60/439,385, filed on Jan. 9, 2003.

(51) Int. Cl.

| | |
|---|---|
| ***B65D 43/16*** | (2006.01) |
| ***B65D 43/22*** | (2006.01) |
| ***B65D 51/04*** | (2006.01) |
| *B65D 43/24* | (2006.01) |
| *B65D 53/00* | (2006.01) |

(52) U.S. Cl. ..... 220/836; 220/791; 220/835; 220/841; 220/849

(58) Field of Classification Search ..... 220/810, 220/831–836, 842, 849, 841, 578, 326, 789–793, 220/627

See application file for complete search history.

(56) References Cited

U.S. PATENT DOCUMENTS

| | | | | | |
|---|---|---|---|---|---|
| 1,219,468 | A | * | 3/1917 | Connor | 220/842 |
| 1,432,181 | A | * | 10/1922 | Hake, Jr. | 220/842 |
| 1,515,839 | A | * | 11/1924 | Connor | 132/305 |
| 1,877,038 | A | * | 9/1932 | Partiot | 220/836 |
| 2,117,228 | A | * | 5/1938 | Stuchbery | 220/841 |
| 2,195,161 | A | * | 3/1940 | Baker | 220/841 |
| 2,263,446 | A | * | 11/1941 | Sebell | 220/842 |
| 2,296,599 | A | * | 9/1942 | Costello | 220/841 |
| 2,564,296 | A | * | 8/1951 | Costello | 220/841 |
| 2,564,298 | A | | 8/1951 | Costello | |
| 2,571,714 | A | * | 10/1951 | Henchert | 220/842 |
| 3,063,549 | A | * | 11/1962 | Weichselbaum | 206/456 |
| 3,663,990 | A | * | 5/1972 | Shane | 16/269 |
| 4,471,881 | A | * | 9/1984 | Foster | 220/837 |
| 4,538,731 | A | * | 9/1985 | Cillario | 206/540 |
| 4,634,019 | A | * | 1/1987 | Pherigo | 220/810 |
| 4,892,247 | A | * | 1/1990 | Dirksing et al. | 229/125.26 |
| D386,001 | S | * | 11/1997 | Saffran | D9/573 |
| 5,860,528 | A | * | 1/1999 | Emery | 206/521.1 |
| 5,878,873 | A | * | 3/1999 | Clark | 206/6 |
| 6,092,690 | A | * | 7/2000 | Bitowft et al. | 220/831 |
| D471,804 | S | * | 3/2003 | Staples | D9/423 |
| D473,461 | S | * | 4/2003 | Joubert | D9/423 |
| D493,617 | S | * | 8/2004 | Armato | D3/294 |

FOREIGN PATENT DOCUMENTS

| | | |
|---|---|---|
| DE | 613712 | 12/1931 |
| GB | 365757 | 1/1932 |
| GB | 651957 | 4/1951 |

* cited by examiner

*Primary Examiner*—Nathan J. Newhouse
*Assistant Examiner*—Niki M. Eloshway
(74) *Attorney, Agent, or Firm*—Gardner Carton & Douglas LLP

(57) ABSTRACT

A container including a receptacle with a closed bottom, an interior space, and an open top encircled by a top receptacle edge, a lid for closing the top of the receptacle where the lid is pivotably attached at a portion of the top receptacle edge and includes a portion extending beyond the edge, and a pillow portion attached to the lid and dimensioned to rest within the interior space of the receptacle when the lid is closed.

17 Claims, 3 Drawing Sheets

HINGED LID CONTAINER

CROSS-REFERENCE TO RELATED PATENT APPLICATIONS

This patent application claims the benefit of U.S. Provisional Patent Application No. 60/439,385, filed Jan. 9, 2003.

BACKGROUND OF THE INVENTION

This invention relates generally to hinged lid containers and, more particularly, to a hinged lid container which can be easily opened and closed using one hand. The container is particularly well suited for storing candy or gum pieces which a user might desire to store in a pocket, purse, or briefcase and then, dispense from time to time using one hand.

There are many types of containers that are suitable for storing products like candy and gum pieces which must be available to be dispensed quickly and conveniently, and that can be readily stored in the user's pocket, purse, etc. Present containers suffer a number of drawbacks, however, including covers that are easily separated and lost, covers that cannot be held and opened using one hand, containers with inconvenient hinged covers, and containers that are subject to unintended opening resulting in wasteful and annoying spillage of the container contents. Also, many of the prior designs are unduly complex or expensive to manufacture.

The present invention solves these problems and others inherent in prior art container designs. It is well suited to storing products like candy and gum pieces which must be available to be dispensed quickly and conveniently. The container of the present invention can be readily stored in the user's pocket, purse, briefcase, etc. The lid of the container is of a convenient and reliable hinged design which can be easily and securely closed, and which can be opened without difficulty. The container of the invention is, nevertheless, of a simple and straightforward design and it is relatively inexpensive to manufacture. Finally, the container is well-suited to be held and opened/closed using one hand.

DETAILED DESCRIPTION OF THE PREFERRED EMBODIMENT

Figure 1:
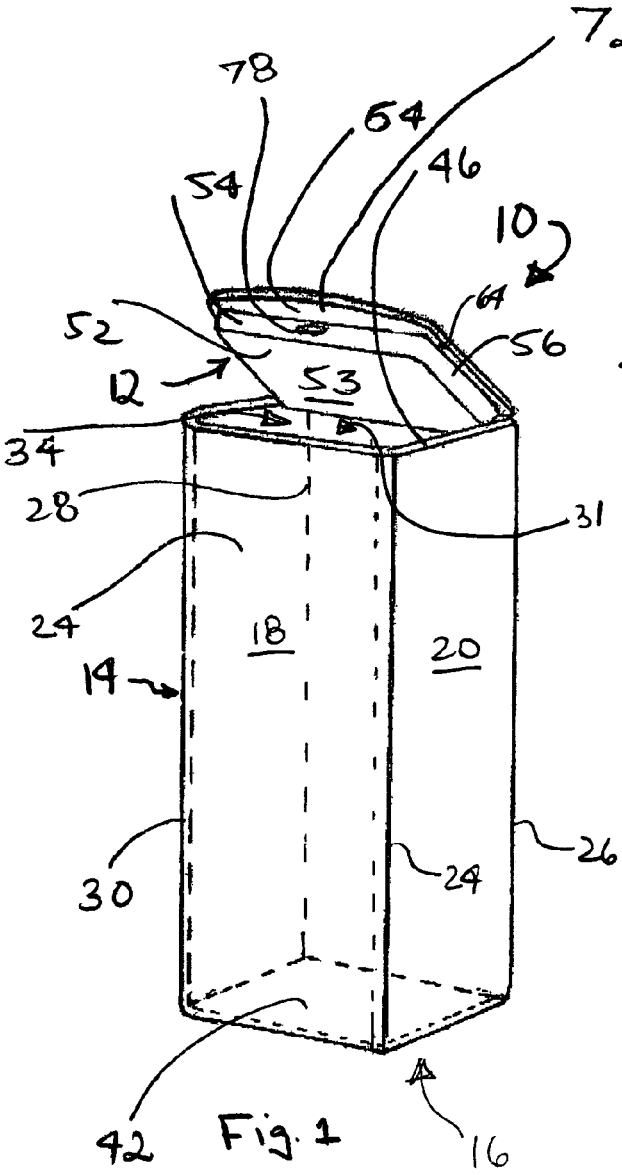
FIG. 1 is a perspective view of the container of the present invention, showing its hinged lid in a partially opened position.
Figure 2:
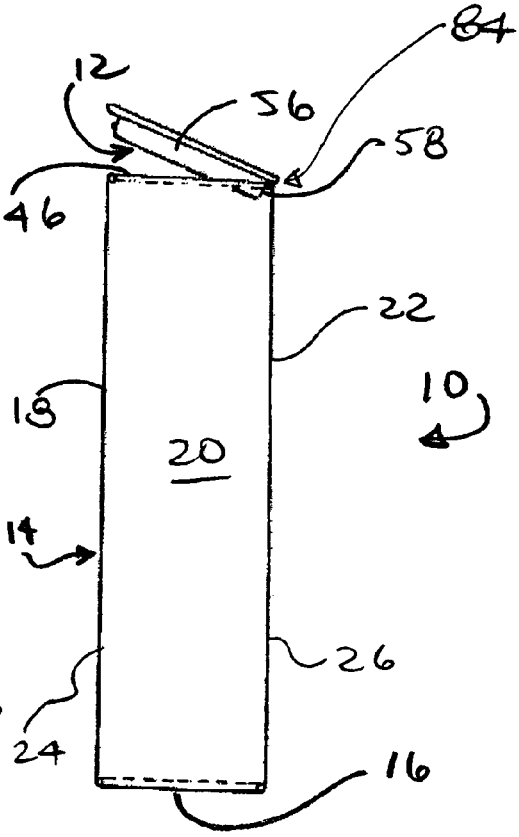
FIG. 2 is a side elevation view of the container of FIG. 1.
Figure 4:
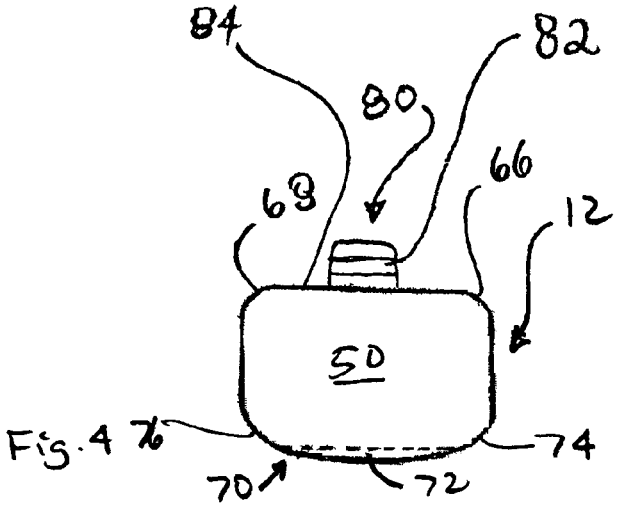
FIG. 4 is a top plan view of the container of FIG. 1.
Figure 6:
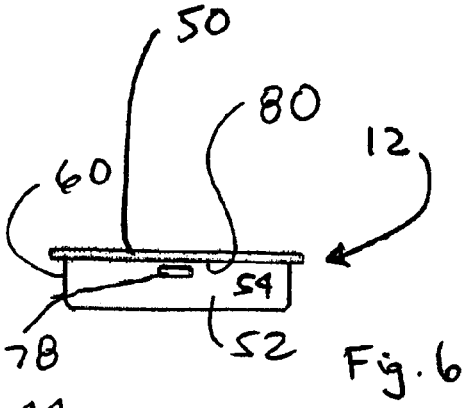
FIG. 6 is a front elevation view of the back of the container of the present invention.
Figure 3:
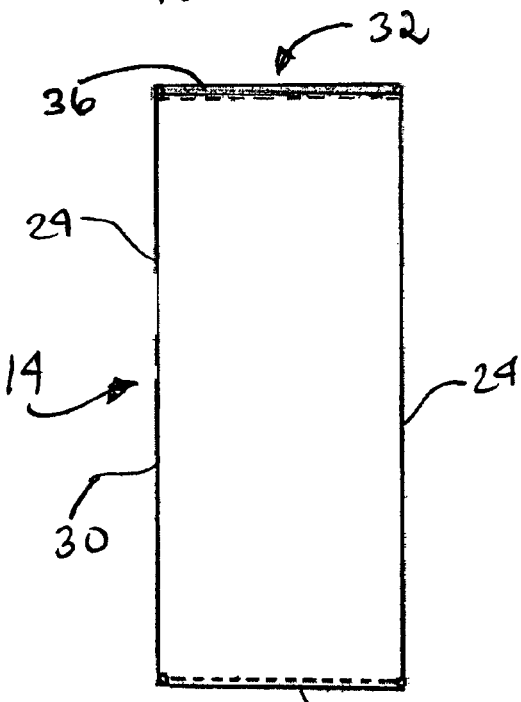
FIG. 3 is a front elevation view of the container of FIG. 1.
Figure 5:
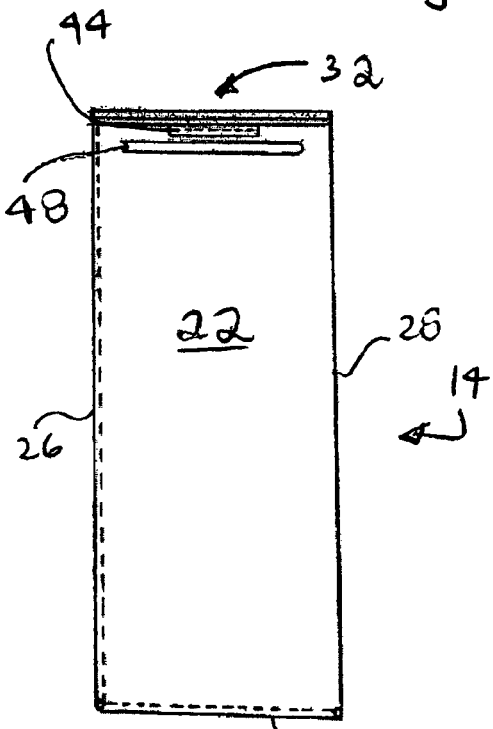
FIG. 5 is a front elevation view of the lid of the of FIG. 1.

The present invention comprises a hinged lid container 10 including a lid 12, and a receptacle 14. Receptacle 14, in the illustrated embodiment, is of an elongated generally rectilinear cuboid shape, having a closed bottom 16 and elongated generally rectangular walls 18, 20, 22, and 24 which meet along curved edges 24, 26, 38, and 30 to provide an interior space 31. The receptacle is open at its top end 32. The receptacle of the container may be a regular cube, or of any other shape, so long as top opening 34 is generally rectangular or square in shape.

Figure 7:
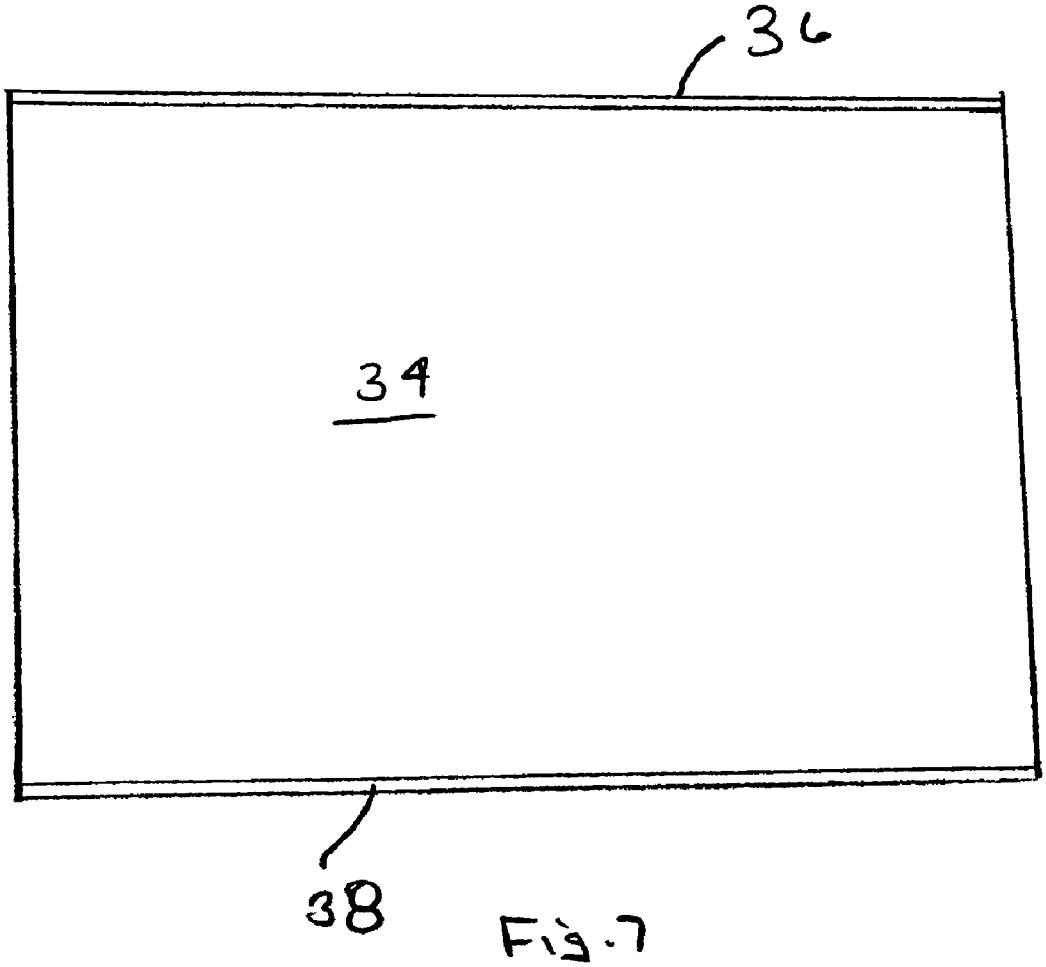
FIG. 7 is a top plan view of a rectangle of sheet metal that can be used in forming the receptacle of the container of the present invention.

The receptacle of the container may be made by conventional techniques. For example, walls 18–24 can be formed from a single piece of thin metal 34 (FIG. 7), in which top and bottom curls 36 and 38 are formed before it is bent about a die by known techniques and joined such as along edge 28 with a locked seam or other joining means. The thin metal may be for example, tin coated steel or aluminum in thicknesses in the range of about 0.0007 inch (0.196 mm) to about 0.0113 inch (0.287 mm). A bottom cover 42 is cut to correspond closely to the dimensions of bottom 16 defined by now closed walls 18–24 and driven to the bottom 16 where it is clenched in place to permanently close the bottom of the receptacle.

Turning now to top end 32 of the container, it is seen that a horizontal slotted opening 44 is formed in the back wall 22 of the container. An elongated concave dimple 48 is debossed into back wall 22 just below slotted opening 44 and extends substantially across the back wall. Curl 36 runs about the periphery of the top edge 46 of the receptacle at its top end.

Lid 12 includes a flat top 50 with a downwardly projecting hollow pillow portion 52 attached thereto by a known clinching process. In this process, pillow portion 52 is preformed, including a flat bottom 53, sides 54, 56, 58, and 60, and a lip 64 projecting from the sides in a plane generally parallel to bottom 52. The pillow is thus attached to the top by turning the edges of top 50 under lip 64 about the perimeter of the pillow portion. As shown, the pillow portion is dimensioned to fit snugly into interior space 31. Top surface 50 is radiused at its corners 66 and 68 to correspond generally to the configuration of the receptacle of the container defined by walls 18–24. The front edge 70 of top 50, however, projects forwardly to create an overhang 72 projecting beyond front wall 18 of the receptacle when the lid is in its closed position. While overhang 72 in the illustrated embodiment is a simple curve intersecting rounded corners 74 and 76 of the lid other shaped overhang can, of course, be used.

An outwardly projecting dimple 78 is formed in the front wall 54 of pillow portion 52. Dimple 78 is spaced from the lower surface 80 of flat top 50 a distance corresponding generally to the diameter of curl 36.

A hinge tongue 80 is punched out of the back wall 58 of pillow portion 52, and an elongated dimple 82 is debossed in the hinge portion. A hinge 84 is then formed by passing tongue 80 through slotted opening 44 and pressing the exposed portion of the tongue home towards pillow back wall 58 until the lid is locked onto the receptacle of the container with a portion of curled lip captured within dimple 82.

The container is operated as follows. Beginning with an open container, the desired contents (e.g., candy or gum pieces) are loaded into the receptacle of the container to a level spaced from the top edge of curl 36 at least a distance equal to the height of the walls 54–60 of the pillow portion. The lid is then rotated into a closed position with the pillow portion resting within the top of the receptacle of the container. As the lid is rotated home, dimple 78 will encounter resistance at curl 36 requiring that it be forced with light pressure into a closed position with the dimple below the curl. Once the dimple rests below the curl, it effectively locks the lid in place and prevents inadvertent opening of the container.

The container typically then will be wrapped and sold to a consumer. The consumer will remove the wrapping and, grasping the receptacle of the container with the fingers of one hand, will recognize the visual and tactile cue of overhang 72 and, using the thumb of the same hand that is grasping the container, push up under the overhang to move dimple 78 past curl 36 and open the container to dispense some of the container contents into the user's other hand (or elsewhere). It is worth noting that the container lid can be fully opened without damaging the receptacle or the lid since elongated dimple 48 receives the back edge 84 of flat top 50 when the lid is in its fully opened position. Also, when the user re-closes the cap, the pillow helps produce a secure seal of the top of the container, and lends opening and closing operations an overall solid feel. Finally, as back wall 58 of the pillow portion rotates into place behind wall 22 of the receptacle, the pillow also helps the hinge resist pullout.

While the present invention is described above in connection with specific embodiments, the invention is intended to cover all alternatives, modifications or equivalents that may be included within its sphere or scope.

What is claimed is:

1. A container comprising:

a receptacle having a closed bottom, a front wall, an interior space, and an open top encircled by a top receptacle edge;

a lid having a top and bottom surface for closing the open top of the receptacle, the lid being pivotally attached adjacent the top receptacle edge and including a lid overhang extending beyond the top receptacle edge, the overhang projecting beyond the receptacle front wall when the lid is closed; and a pillow portion having a bottom and a side wall, the side wall extending downwardly from the bottom surface of the lid, and the pillow portion being dimensioned to fit snugly within the interior space of the receptacle when the lid rests on the top receptacle edge, the lid being attached to the receptacle by way of a tongue formed in the pillow that passes through a horizontal slotted opening in the receptacle adjacent the top receptacle edge.

2. The container of claim 1 in which the receptacle is elongated and the open top is rectangular.

3. The container of claim 1 in which the receptacle is formed from a single sheet of metal.

4. The container of claim 3 in which the sheet of metal has a thickness of about 0.0007 to about 0.0113 inches.

5. The container of claim 1 in which an inward curl is formed along the top receptacle edge.

6. The container of claim 1 in which the pillow includes an outwardly projecting dimple spaced from the top surface of the lid a distance corresponding to the diameter of the curl whereby the lid is removably captured in a closed position when the dimple sits below the curl.

7. The container of claim 1 in which the receptacle includes an elongated dimple for receiving an edge of the lid when it is in a fully open position.

8. The container of claim 1 wherein the overhang projects from the side of the pillow in a plane generally parallel to the bottom of the pillow portion.

9. The container of claim 1 wherein the edges of the top are turned under about the perimeter of the pillow portion.

10. The container of claim 1 wherein the top surface of the lid is flat.

11. A container comprising:

a rectilinear receptacle having a closed bottom, an interior space, a front wall, and a generally rectangular open top encircled by a top receptacle edge;

a generally rectangular lid having a top and bottom surface for closing the top of the receptacle, the lid further including a lid overhang extending beyond the top receptacle edge and projecting beyond the receptacle front wall when the lid is closed;

a pillow portion having a bottom and a side wall, the side wall extending from the bottom surface of the lid, the pillow portion being dimensioned to fit snugly within the interior space of the receptacle when the lid rests on the top receptacle edge;

wherein the lid is pivotally attached adjacent the top receptacle edge by way of a tongue formed in the pillow portion that passes through a horizontal slotted opening in the receptacle adjacent the top receptacle edge.

12. The container of claim 11 in which the receptacle is formed from a single sheet of metal having a thickness of about 0.0007 to about 0.0113 inches.

13. The container of claim 11 in which an inward curl is formed along the top receptacle edge.

14. The container of claim 11 in which the pillow includes an outwardly projecting dimple spaced from the top surface of the lid a distance corresponding to the diameter of the curl whereby the lid is removably captured in a closed position when the dimple sits below the curl.

15. The container of claim 11 in which the receptacle includes an elongated dimple for receiving an edge of the lid when it is in a fully open position.

16. A container comprising:

a rectilinear receptacle having a closed bottom, an interior space, a front wall, and a generally rectangular open top encircled by a top receptacle edge;

an inward curl formed along the top receptacle edge;

a generally rectangular lid having a top and bottom surface for closing the top of the receptacle, the lid being pivotally attached by a hinge adjacent the top receptacle edge and including a lid overhang projecting beyond the receptacle front wall when the lid is closed;

a hollow rectangular pillow portion having a bottom and a side wall, the side wall extending from the bottom of the lid, the pillow portion being dimensioned to fit snugly within the interior space of the receptacle when the lid rests on the top receptacle edge; and an outwardly projecting dimple on the pillow portion opposite the hinge, the dimple being spaced from the bottom surface of the lid a distance corresponding to the diameter of the curl whereby the lid is removably captured in a closed position with the pillow resting within the interior space of the receptacle when the dimple sits below the curl.

17. The container of claim 16 wherein the overhang is a curve intersecting the corners of the lid and projects forwardly beyond the front wall of the receptacle.

* * * * *